US010246302B2

(12) United States Patent
Hamlett et al.

(10) Patent No.: US 10,246,302 B2
(45) Date of Patent: Apr. 2, 2019

(54) AUXILIARY PUMPING UNIT

(71) Applicant: ThyssenKrupp Elevator Corporation, Atlanta, GA (US)

(72) Inventors: Anthony Frank Hamlett, Franklin, TN (US); Roy Walker, Bartlett, TN (US); Gary Hooper, Rathdrum, ID (US)

(73) Assignee: ThyssenKrupp Elevator Corporation, Atlanta, GA (US)

( * ) Notice: Subject to any disclaimer, the term of this patent is extended or adjusted under 35 U.S.C. 154(b) by 928 days.

(21) Appl. No.: 14/305,674

(22) Filed: Jun. 16, 2014

(65) Prior Publication Data

US 2015/0360910 A1 Dec. 17, 2015

(51) Int. Cl.

| | |
|---|---|
| ***B66B 11/04*** | (2006.01) |
| ***F15B 11/08*** | (2006.01) |
| ***F15B 1/26*** | (2006.01) |
| ***F15B 21/08*** | (2006.01) |
| ***B66B 5/00*** | (2006.01) |
| ***F04B 23/02*** | (2006.01) |
| ***F04B 23/04*** | (2006.01) |
| ***F04B 49/035*** | (2006.01) |
| ***F04B 49/06*** | (2006.01) |
| ***F04B 49/10*** | (2006.01) |

(52) U.S. Cl.

CPC ..... *B66B 11/0423* (2013.01); *B66B 5/0087* (2013.01); *F04B 23/02* (2013.01); *F04B 23/04* (2013.01); *F04B 49/035* (2013.01); *F04B 49/06* (2013.01); *F04B 49/106* (2013.01); *F15B 2211/20576* (2013.01); *F15B 2211/85* (2013.01); *F15B 2211/8757* (2013.01)

(58) Field of Classification Search

CPC ..... B66B 9/04; B66B 11/0423; B66B 5/0087; F04B 23/02; F04B 23/04

See application file for complete search history.

(56) References Cited

U.S. PATENT DOCUMENTS 4,149,382 A * 4/1979 Holsomback ..... B66B 9/04 187/276
6,505,711 B1 * 1/2003 Zurcher ..... B66B 1/24 187/275

(Continued)

FOREIGN PATENT DOCUMENTS

JP H 10-226462 A 8/1998
JP 3-371705 B2 1/2003

OTHER PUBLICATIONS

AIPN Machine Translation, JP 10-226462 A, Aug. 23, 2017 (JST), pp. 1-7.*

(Continued)

*Primary Examiner* — Diem M Tran
(74) *Attorney, Agent, or Firm* — Frost Brown Todd LLC

(57) ABSTRACT

A pumping unit for use with a hydraulic elevator system includes a reservoir storing fluid, a first pump, and a second pump. The first pump is coupled with the reservoir and the elevator system to communicate fluid between the reservoir and the elevator system to actuate the elevator system. The second pump is also coupled with the reservoir and the elevator system to communicate fluid between the reservoir and the elevator system to actuate the elevator system. The second pump is selectively actuatable when the first pump is inactivated.

17 Claims, 6 Drawing Sheets

(56) References Cited

U.S. PATENT DOCUMENTS

| | | | | |
|---|---|---|---|---|
| 6,957,721 | B2 * | 10/2005 | Moser | B66B 9/04 187/275 |
| 2004/0074702 | A1 * | 4/2004 | Moser | B66B 9/04 187/275 |

OTHER PUBLICATIONS

Canadian Office Action dated Apr. 26, 2016 for Application No. CA 2,892,648, 3 pgs.
Canadian Office Action dated May 17, 2018 for Application No. CA 2,970,636, 3 pgs.

* cited by examiner

AUXILIARY PUMPING UNIT

FIELD

The present disclosure relates to pumping units of hydraulic elevators and elevator systems.

BACKGROUND

Some elevator systems use a hydraulic pumping system to raise and lower an elevator car. In such systems, hydraulic fluid is pumped to hydraulic cylinders to drive an elevator car upward. Hydraulic fluid is released from the hydraulic cylinders to permit the force of gravity acting on the elevator car to drive the elevator car downward. Over time, the primary pumping unit used in such systems can fail or become inoperable for various reasons and require maintenance or replacement. In some such systems, access to the primary pumping unit may be blocked by the elevator car when the primary pumping unit fails—for instance when the primary pumping unit is located in the hoistway space at the lowest floor and the elevator car happens to be positioned at the lowest floor. Lifting the elevator car manually can be done but requires the use of ladders to manually install a hoisting device on an overhead structure capable of supporting the hoisting device and the elevator car. This can be cumbersome, time consuming, and involve safety risks.

While a variety of equipment and systems have been made and used to raise and lower an elevator when a primary system is inoperable and needs service, it is believed that no one prior to the inventor(s) has made or used an invention as described herein.

SUMMARY

Disclosed herein are embodiments of a pumping unit for a hydraulic elevator system, where the pumping unit comprises a primary pump and an auxiliary or secondary pump, both capable of providing fluid to one or more hydraulic cylinders of the elevator system to drive an elevator car upward. Accordingly, it is at least one of the objects of the present disclosure to provide a backup or secondary device for driving an elevator car upward when a primary device is inoperable.

Also disclosed herein are embodiments of methods for raising and/or lowering an elevator car of a hydraulic elevator system using an auxiliary or secondary pump when a primary pump is inoperable. Accordingly, it is least one of the objects of the present disclosure to provide a method for operating a backup or secondary device to drive an elevator car upward when a primary device is inoperable.

BRIEF DESCRIPTION OF THE DRAWINGS

While the specification concludes with claims which particularly point out and distinctly claim the invention, it is believed the present invention will be better understood from the following description of certain embodiments taken in conjunction with the accompanying drawings, in which like reference numerals identify the same elements.

Figure 1:
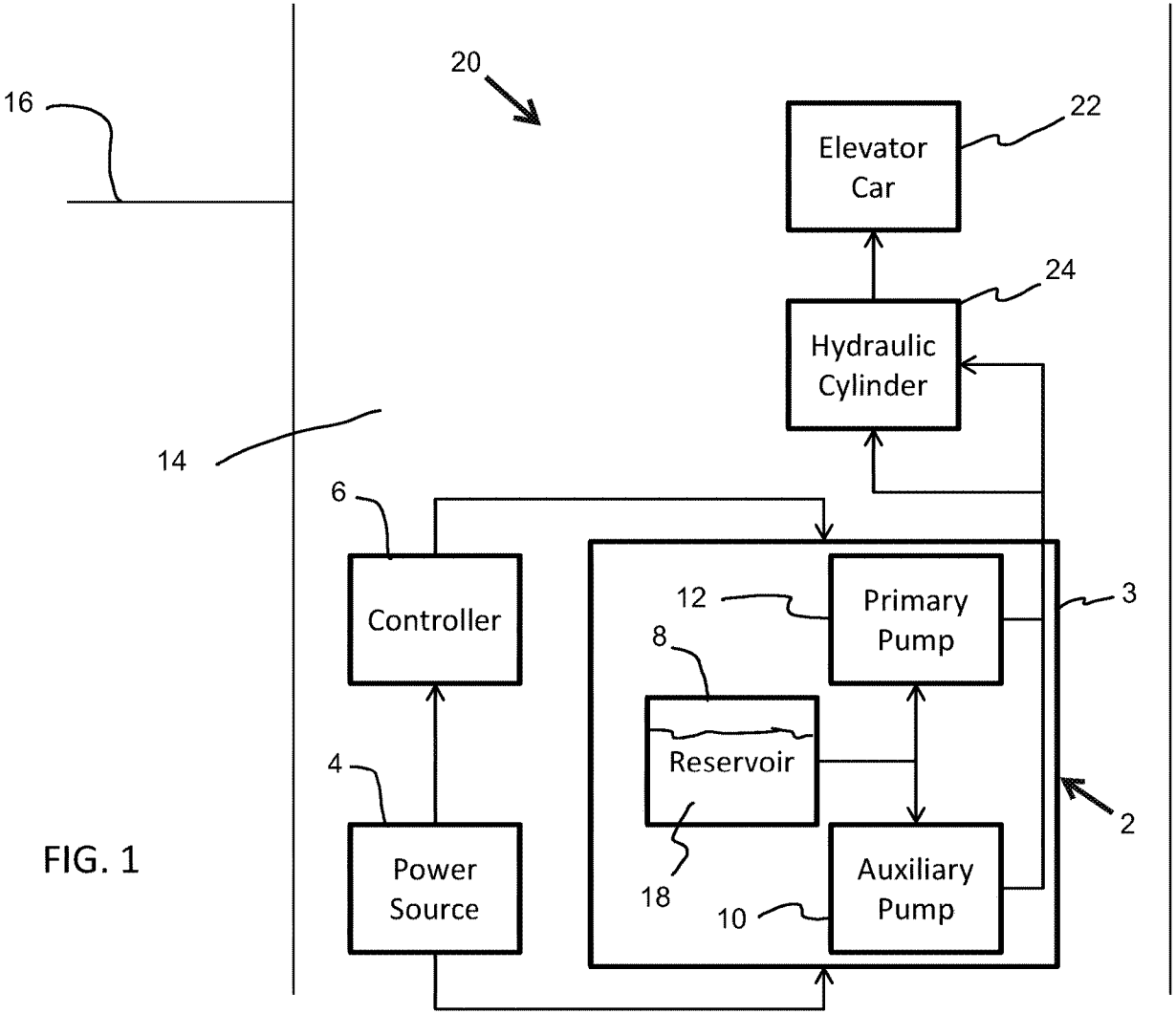
FIG. 1 is a schematic diagram of an embodiment of a hydraulic pumping unit and elevator system, as disclosed herein.
Figure 2:
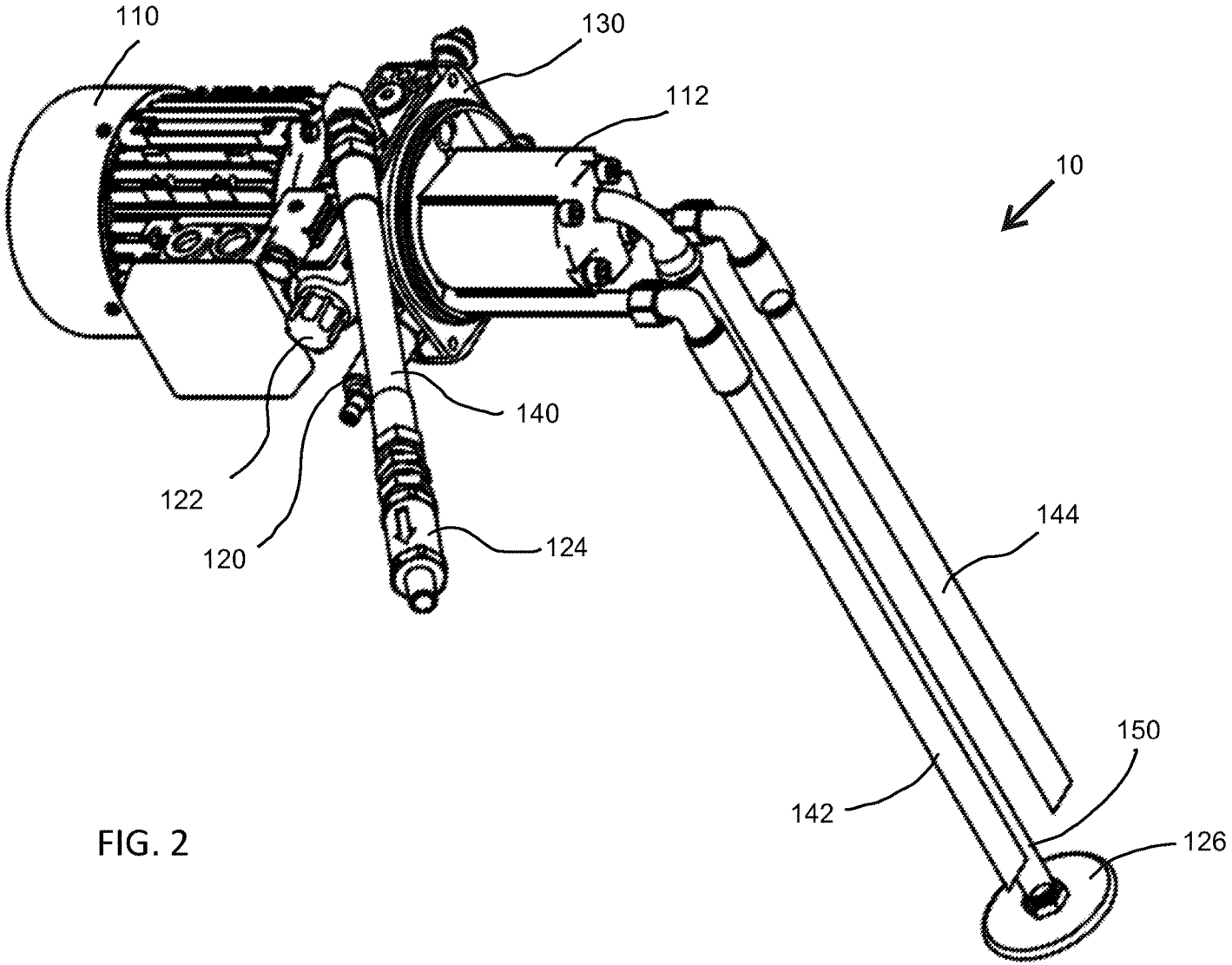
FIG. 2 is a perspective view of an embodiment of an auxiliary pump of the pumping unit of FIG. 1.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain embodiments of the present disclosure should not be used to limit the scope of the present disclosure. Other examples, features, aspects, embodiments, and advantages of the invention will become apparent to those skilled in the art from the following description, which is by way of illustration, one of the best modes contemplated for carrying out the invention. As will be realized, various aspects of the present disclosure may take alternate forms, or have alternate or additional embodiments, without departing from the scope of the present disclosure. Accordingly, the drawings and descriptions should be regarded as illustrative in nature and not restrictive.

I. Elevator System and Pumping Unit

FIG. 1 shows a schematic diagram of an embodiment of a hydraulic elevator system (20) comprising a power source (4), an elevator controller (6), a hydraulic pumping unit (2), a hydraulic cylinder (24), and an elevator car (22). Pumping unit (2) comprises a tank (3), a reservoir (8) containing hydraulic fluid or oil (18), a primary pump (12), and an auxiliary pump (10). Elevator system (20) is within a hoistway (14), and throughout hoistway (14) are landings at the various floors of the building. Elevator car (22) is driven by a hydraulic cylinder (24) which raises and/or lowers elevator car (22). Hydraulic cylinder (24) of elevator system (20) is actuated by pumping unit (2). Elevator system (20) can be positioned above pumping unit (2) within hoistway (14) such that pumping unit (2) is beneath a first landing (16) of elevator system (20). Although one hydraulic cylinder (24) is shown in FIG. 1, elevator system (20) can include more than one hydraulic cylinder (24) to drive elevator car (22). Other suitable configurations for elevator system (20) will be apparent to one with ordinary skill in the art in view of the teachings herein.

Power source (4) is operable to supply power to controller (6), primary pump (12), and auxiliary pump (10). In some embodiments multiple power sources (4) can be used. For instance one power source (4) can provide power to primary pump (12) and auxiliary pump (10), and another power source (4) can provide power to controller (6). Exemplary power sources (4) include, but are not limited to, a generator or building power. Building power can be that power provided to the building by a utility provider or power created within the building itself. In some embodiments controller (6) receives power from power source (4) and then pumping unit (2) is provided power by way of controller (6) to power primary pump (12) and auxiliary pump (10). Other suitable configurations for providing power to elevator system (20) will be apparent to one with ordinary skill of the art in view of the teachings herein.

Controller (6) is connected to and in communication with at least one of pumping unit (2), primary pump (12), and/or auxiliary pump (10), and is configured to send control signals thereto to actuate at least one of primary pump (12) and/or auxiliary pump (10). In this fashion, controller (6) controls or drives elevator car (22) through actuating primary pump (12) or auxiliary pump (10) to provide hydraulic fluid (18) to hydraulic cylinder (24). Controller (6) is further connected to and in electrical communication with an input device (not shown), such as an elevator car operating panel and/or other device, that sends input signals to controller (6), so that controller (6) operates pumping unit (2) in a desired fashion. In view of the teachings disclosed herein, various ways to configure controller (6) to drive elevator car (22) via pumping unit (2) will be apparent to those of ordinary skill in the art.

Referring still to FIG. 1, reservoir (8) of pumping unit (2) is in fluid communication with primary pump (12) and auxiliary pump (10). Reservoir (8) stores and supplies hydraulic fluid or oil (18) for use with primary pump (12) and auxiliary pump (10). Primary pump (12) and auxiliary pump (10) are coupled to hydraulic cylinder (24) of elevator system (20) and are together configured to raise elevator car (22) within the elevator hoistway. In the present embodiment, primary pump (12) is configured as the primary means of driving elevator car (22) upward. If primary pump (12) becomes inoperable, auxiliary pump (10) of pumping unit (2) is configured as an alternate means to drive elevator car (22) upward in the hoistway. Auxiliary pump (10) can comprise the same or different specifications as primary pump (12). In the present embodiment, auxiliary pump (10) has a lower power rating and flow rate than primary pump (12), but this is not required in all embodiments. In the present embodiment, auxiliary pump (10) has a 1 horsepower motor that delivers a flow rate of 4.1 gallons per minute and has a maximum working pressure of 362 pounds per square inch.

As shown in FIG. 1, auxiliary pump (10) is mounted within the same tank (3) as primary pump (12). Furthermore, both auxiliary pump (10) and primary pump (12) are fluidly connected with the same reservoir (8) and source of hydraulic fluid (18). In alternate embodiments, auxiliary pump (10) can be mounted in other configurations. For instance in some other embodiments, auxiliary pump (10) can be mounted outside of tank (3) while primary pump (12) remains mounted inside of tank (3). In still further alternate embodiments auxiliary pump (10) can be connected to a source of hydraulic fluid that is separate from the source of hydraulic fluid for primary pump (12). Still other ways to mount and configure auxiliary pump (10) will be apparent to those of ordinary skill in the art in view of the teachings herein.

FIGS. 2-5 show an embodiment of an auxiliary pump (10) as disclosed herein in more detail. Auxiliary pump (10) is configured to pump hydraulic fluid to a hydraulic lift cylinder of an elevator car, and comprises a motor (110), a pump (112), a manifold (130), an inlet conduit (150), a bypass conduit (144), an outlet conduit (140), and a relief conduit (142). Motor (110) of auxiliary pump (10) is operable to drive pump (112). Motor (110) of the present embodiment is an AC motor that is configured to run on a single phase 110 VAC circuit. The size of motor (110) can be 1 horsepower. Of course, in alternate embodiments, other suitable configurations for motor (110) will be apparent to one with ordinary skill in the art in view of the teachings herein. A motor contactor (116) is positioned to receive power from power source (4) and activate motor (110). Power can be supplied to motor contactor (116) through controller (6), another controller (not shown) of elevator system (20), or remotely. Additionally, a switch (129), such as a non-latching key switch, can be positioned between power source (4) and contactor (116) to selectively provide power to motor (110). By requiring a key to activate such a switch, and thereby motor (110), access to operate auxiliary pump (10) can be restricted.

Figure 4:
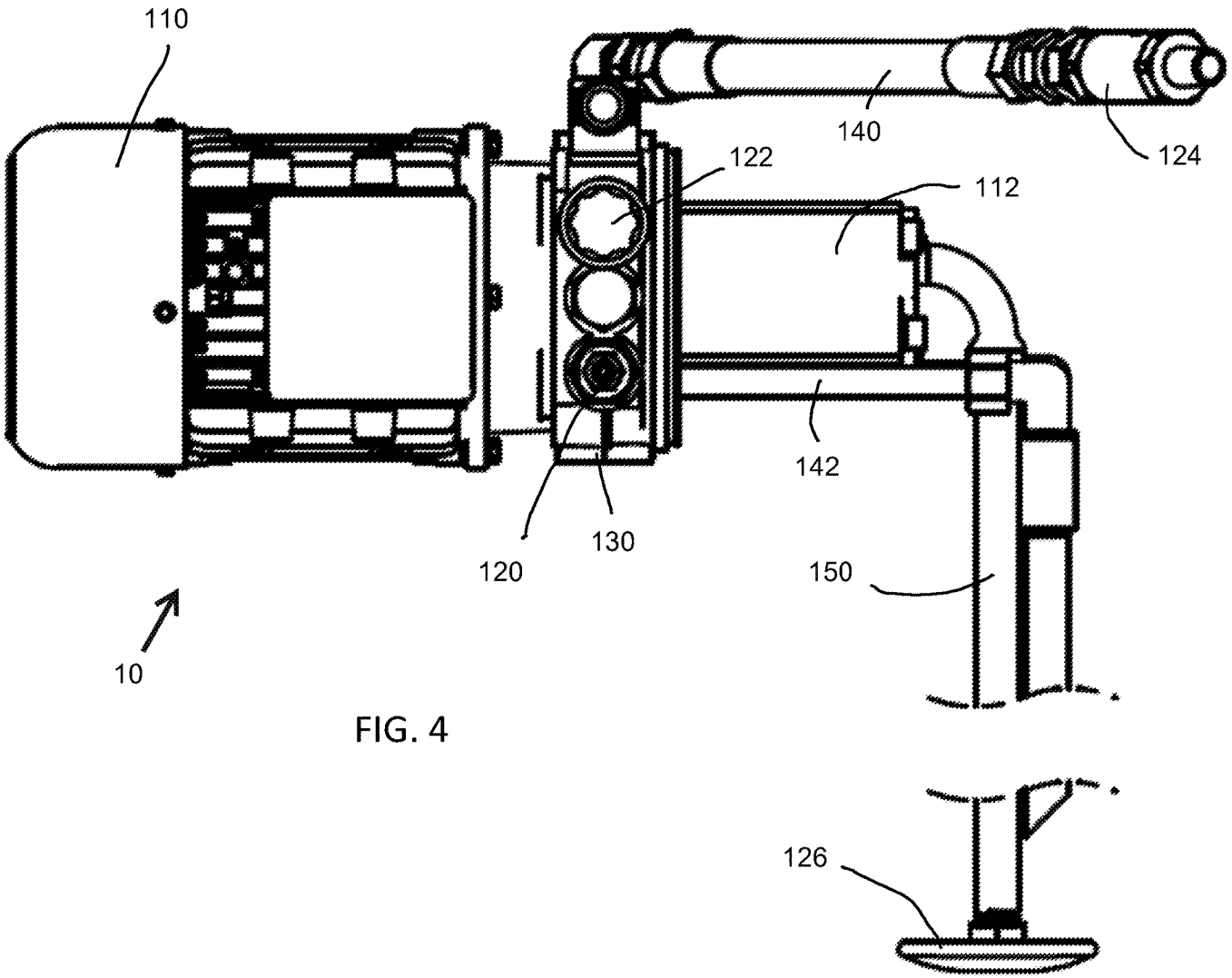
FIG. 4 is a side elevational view of an embodiment of the auxiliary pump of FIG. 2.
Figure 5:
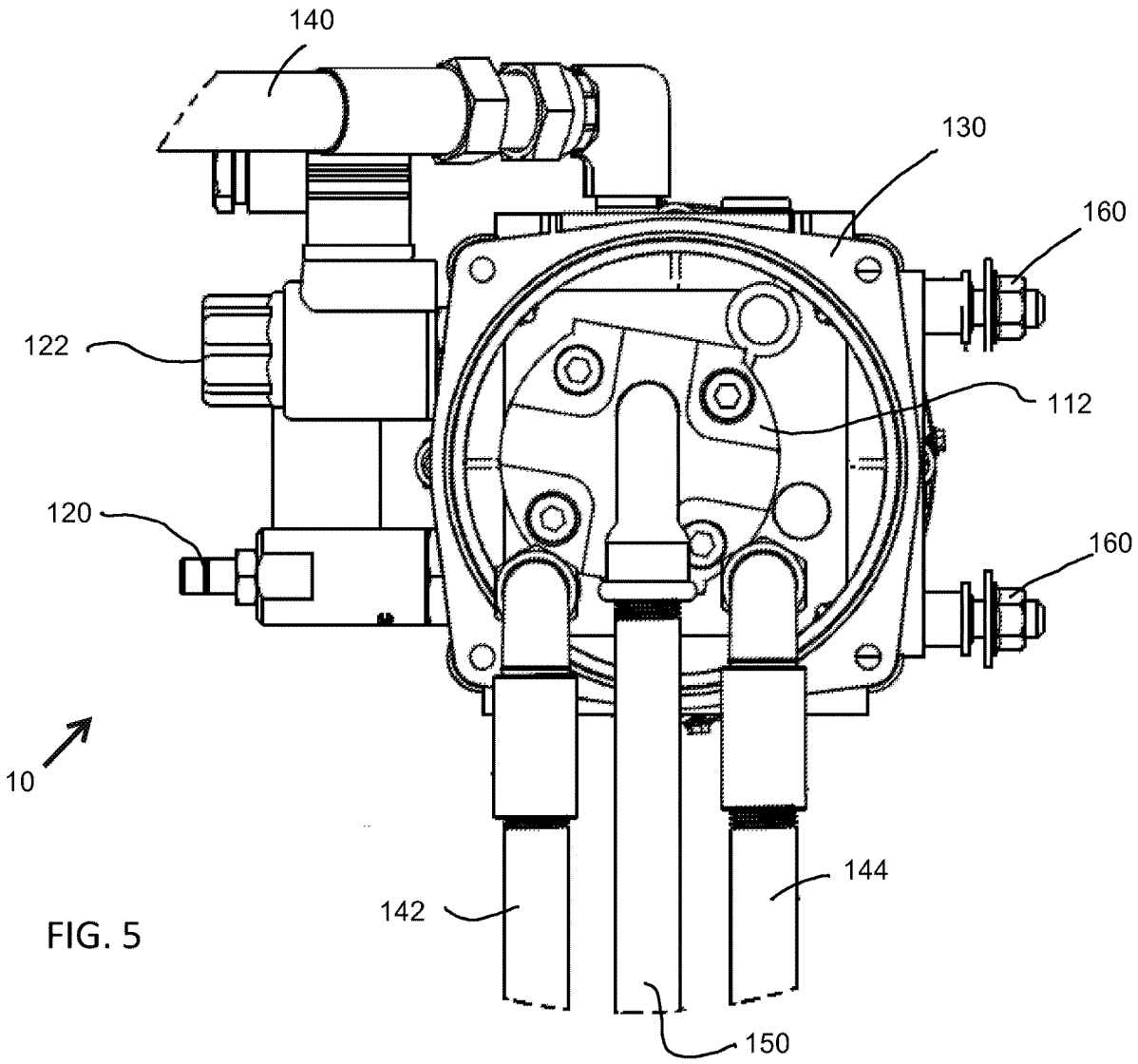
FIG. 5 is a partial front view of an embodiment of the auxiliary pump of FIG. 2.

Motor (110) is coupled to pump (112) to drive pump (112). Pump (112) can be a positive displacement pump. As best seen in FIGS. 4-5, pump (112) is coupled to reservoir (8) (not shown in FIGS. 4-5) via inlet conduit (150). Inlet conduit (150) includes a strainer (126) to separate debris and/or other objects from the oil in reservoir (8) that can harm pump (112). Accordingly, pump (112) suctions oil from reservoir (8) through strainer (126) and inlet conduit (150). In one embodiment, pump (112) and/or motor (110) may be submersible such that auxiliary pump (10) can be placed within the oil of reservoir (8), but this is not required in all embodiments. In alternate embodiments, auxiliary pump (10) may be positioned external to reservoir (8). Pump (112) is coupled with manifold (130), which receives oil from reservoir (8). As best seen in FIGS. 4 and 5, manifold (130) is coupled with bypass conduit (144), outlet conduit (140), and relief conduit (142).

Figure 3:
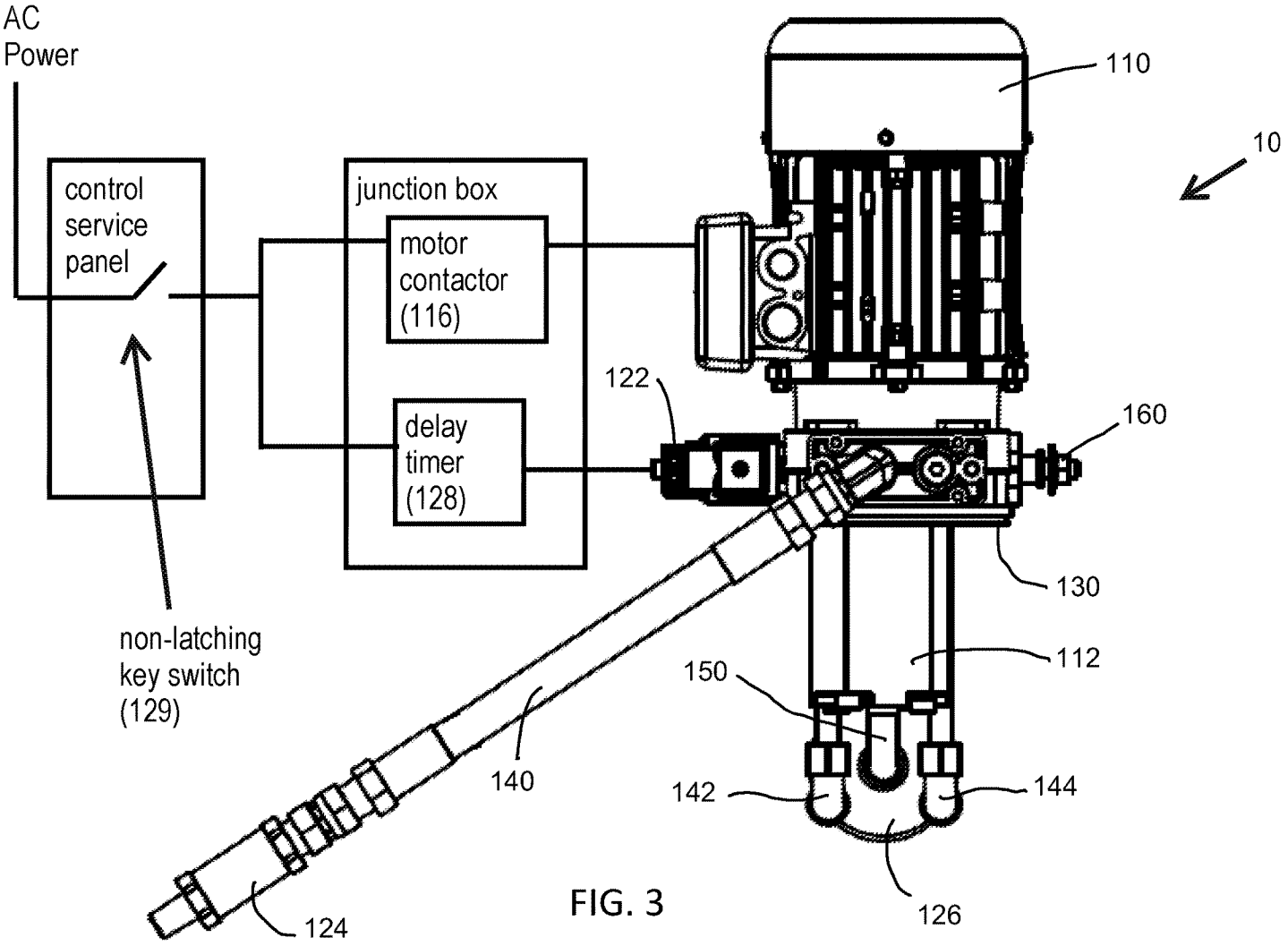
FIG. 3 is a top plan view of an embodiment of the auxiliary pump of FIG. 2.

Bypass conduit (144) provides a flow path from manifold (130) back to reservoir (8). In the present embodiment, manifold (130) is coupled with bypass conduit (144) through a timer (128) and solenoid valve (122). Solenoid valve (122) is normally open such that oil received in manifold (130) is returned through bypass conduit (144) to reservoir (8). Solenoid valve (122) is then energized to a closed position to close bypass conduit (144), which allows the amount of oil to increase within manifold (130) and pressure to build. Solenoid valve (122) can be energized by power source (4). FIG. 3 shows timer (128) coupled with solenoid valve (122) to delay energizing solenoid valve (122). For example, timer (128) can be set to a certain amount of time such that solenoid valve (122) is energized by power source (4) after timer (128) expires. Timer (128) can be set for a few seconds, or any other suitable amount of time, and can be adjustable. Of course, timer (128) can be omitted such that solenoid valve (122) is directly energized from power source (4).

Manifold (130) is further coupled to outlet conduit (140). As shown in FIGS. 3 and 4, outlet conduit (140) comprises a check valve (124) positioned at the opposing end of outlet conduit (140). Outlet conduit (140) is then coupled to hydraulic cylinder (24) of elevator system (20) through the check valve (124). Check valve (124) is in a closed position until the oil in manifold (130) increases the pressure in manifold (130) to a level above the pressure of elevator system (20). For example, the approximate working pressure of auxiliary pump (10) may be 300 psi. The pressure within manifold (130) can then exceed the pressure within elevator system (20) to open check valve (124). These pressures are exemplary, and other suitable operating pressures and pressure levels and limits will be apparent to one of ordinary skill in the art in view of the teachings disclosed herein. When check valve (124) is in the open position, oil flows from manifold (130) to hydraulic cylinder (24) of elevator system (20) to drive elevator car (22). In the present embodiment, check valve (124) is a one-way check valve such that oil is prevented from flowing back into manifold (130) from elevator system (20).

FIGS. 4 and 5 show that manifold (130) is further coupled with relief conduit (142) through relief valve (120). Relief conduit (142) provides a flow path from manifold (130) to reservoir (8). Relief valve (120) is biased to a closed position by a spring or other biasing member until the pressure within manifold (130) exceeds the maximum pressure limit of relief valve (120). For example, if while pumping hydraulic fluid, the pressure within manifold (130) exceeds the maximum pressure limit of relief valve (120), and therefore places a force on the relief valve (120) in the opposite direction to that of the biasing member of the relief valve, and which force from the manifold pressure is larger than the magnitude of the force of the biasing member acting to keep the relief valve closed, the relief valve (120) is forced open to relieve excess pressure within the manifold and allow oil to flow from manifold (130) back to reservoir (8). Relief valve (120) may be adjustable such that it will selectively open at a varying predetermined pressures, as will be apparent to those of ordinary skill in the art in view of the teachings herein.

Referring back to FIGS. 3 and 5, auxiliary pump (10) includes at least one fastener (160) to secure auxiliary pump (10) within pumping unit (2). Fasteners (160) can include screws, bolts, clamps, nails, pins, and additional alternate fastener types, without limiting the scope of the present disclosure. For example, auxiliary pump (10) can be coupled to the walls of pumping unit (2), the walls of the building, or the walls of reservoir (8). Auxiliary pump (10) is positioned within pumping unit (2) such that the ends of inlet conduit (150), bypass conduit (144), and relief conduit (142) are positioned within reservoir (8). Other configurations for auxiliary pump (10) are contemplated within the scope of the present disclosure, as will be apparent to one of ordinary skill in the art in view of the teachings disclosed herein.

II. Method of Operation

Figure 6:
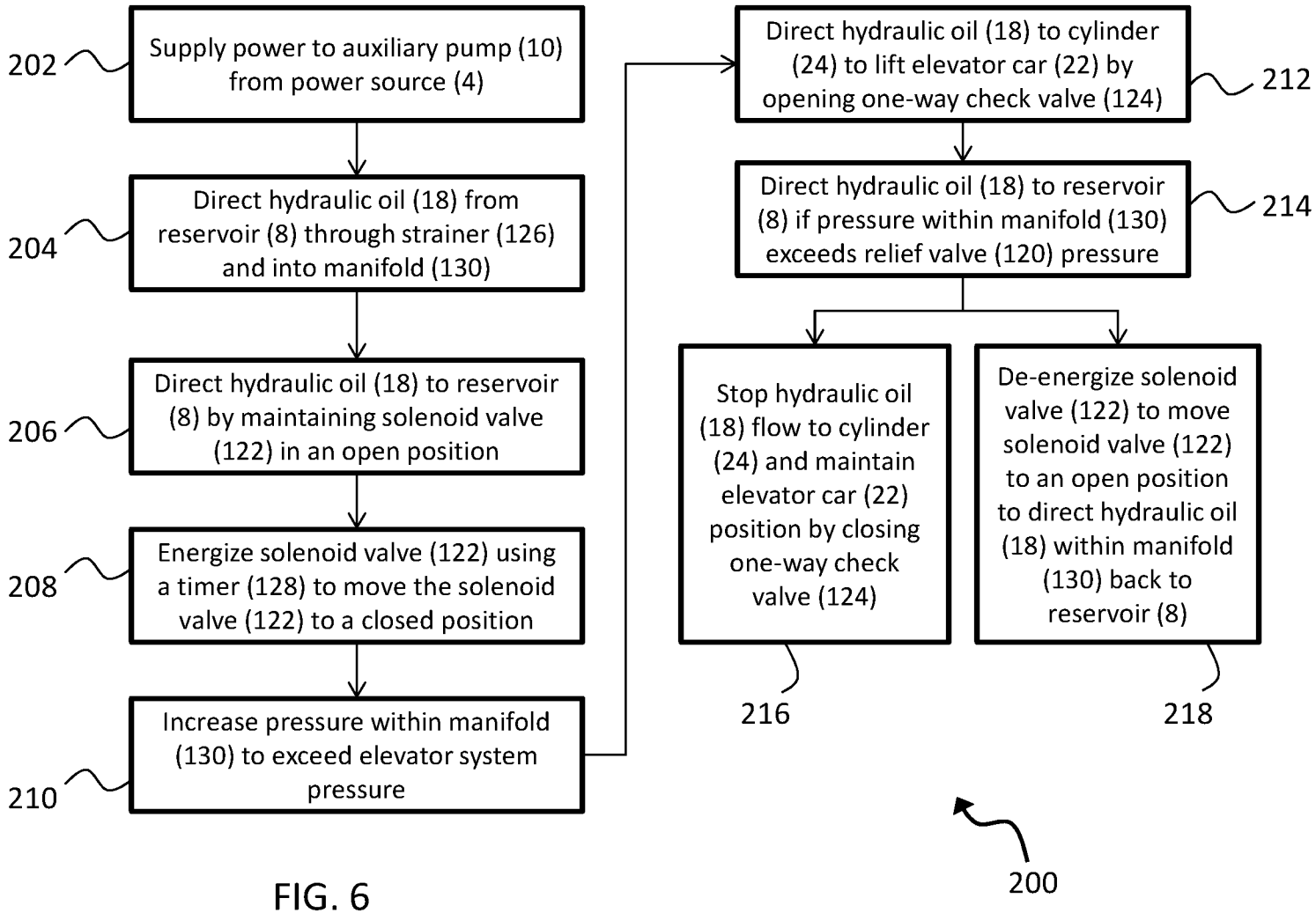
FIG. 6 is a flow chart showing an embodiment of method steps for using the auxiliary pump of FIG. 2.

As described above, auxiliary pump (10) can be used to operate elevator system (20) in place of primary pump (12). FIG. 6 shows an example method (200) for the operation of auxiliary pump (10). At step (202), power is supplied to contactor (116) of auxiliary pump (10) from power source (4). The power to contactor (116) can be supplied directly from power source (4) or selectively through controller (6), another controller (not shown) of elevator system (20), or remotely. A switch (129), such as a non-latching key switch, can also be positioned between power source (4) and contactor (116) to selectively supply power to contactor (116). Once power is supplied to contactor (116), contactor (116) activates motor (110). Motor (110) thereby drives pump (112). At step (204), pump (112) then draws oil from reservoir (8) through strainer (126) and inlet conduit (150) to manifold (130). At step (206), solenoid valve (122) of auxiliary pump (10) is in an open position to return the oil from manifold (130) to reservoir (8) through bypass conduit (144).

At step (208), solenoid valve (122) is energized using timer (128) to move solenoid valve (122) to a closed position. At the same time the contactor (116) is activated, power is supplied to timer (128) by power source (4) to activate timer (128). Upon the expiration in the timer (128) of a preset amount of time, solenoid valve (122) is energized to a closed position. Solenoid valve (122) can be energized by power source (4). Alternatively, solenoid valve (122) can be selectively energized through controller (6). With solenoid valve (122) in the closed position, solenoid valve (122) prevents oil from flowing to reservoir (8) through bypass conduit (144). At step (210), this allows oil to fill manifold (130) and outlet conduit (140) building pressure within manifold (130) and outlet conduit (140).

At step (212), once the pressure within manifold (130) and outlet conduit (140) exceeds the pressure of elevator system (20) by a predetermined amount of pressure, check valve (124) is opened to allow oil to flow from manifold (130) to hydraulic cylinder (124) of elevator system (20). Check valve (124) can be opened mechanically by the pressure of the oil within manifold (130) and outlet conduit (140). In another embodiment, check valve (124) can be opened electrically by controller (6). Check valve (124) is a one-way check valve such that check valve (124) prevents oil from returning from elevator system (20) to manifold (130). With check valve (124) in the open position, oil flows from manifold (130) of auxiliary pump (10) to hydraulic cylinder (24) of elevator system (20). This actuates hydraulic cylinder (24) to thereby drive elevator car (22). Accordingly, elevator car (22) can be raised in response to auxiliary pump (10). For instance, if primary pump (12) is not functioning and elevator car (22) is blocking access to primary pump (12), elevator car (22) can be lifted by activating auxiliary pump (10). Elevator car (22) can also be lowered thereafter by opening a valve in the hydraulic fluid lines and permitting the force of gravity, acting on the raised elevator car, to force the hydraulic fluid (18) out of cylinder (24) and back into reservoir (8), thereby permitting the elevator car to lower as the hydraulic fluid leaves the cylinder (24). In one embodiment, this elevator car (22) lowering may be accomplished using a control valve of the pumping unit (2), e.g. a control valve connected to primary pump (12). In an alternate embodiment, the check valve (124) of the auxiliary pump (10) may be replaced with a combination valve that serves as a check valve and a solenoid operated lower valve. In view of the teaching disclosed herein, other components, configurations, and ways for lowering elevator car (22) will be apparent to one of ordinary skill in the art.

At step (214), if, while pumping hydraulic fluid, the pressure within manifold (130) exceeds a pre-determined amount of pressure, relief valve (120) is opened. Relief valve (120) can be opened mechanically by the pressure of the oil within manifold (130). In another embodiment, relief valve (120) can be opened electrically by controller (6) for example. With relief valve (120) in the open position, oil can flow from manifold (130) to reservoir (8) through relief conduit (142). At step (216), when power is switched off to auxiliary pump (10), motor (110) is deactivated and the flow of hydraulic fluid (18) to cylinder (24) ceases. This flow stoppage causes one-way check valve (124) to close. With check valve (124) closed, oil is prevented from flowing between auxiliary pump (10) and elevator system (20). This holds elevator car (22) in place. At step (218), solenoid valve (122) is de-energized to an open position. This allows oil to flow again from manifold (130) to reservoir (8) through bypass conduit (144). This decreases the pressure within manifold (130), which causes check valve (124) and relief valve (120) to close if valves (124, 120) are not already closed. Primary pump (12) can then be accessed and repaired if needed.

Although auxiliary pump (10) has been described as being incorporated into a pumping unit (2) to operate an elevator system (20), auxiliary pump (10) can be incorporated into any hydraulic pumping unit. Further, two or more auxiliary pumps (10) can be provided in parallel within pumping unit (2) to achieve higher flow rates. This can allow pumping unit (2) to raise the elevator car (22) at a higher speed.

Auxiliary pump (10) can further be used during construction of elevator system (20) to move an empty platform prior to installation of a primary elevator controller within elevator system (20). Also, in some embodiments, auxiliary pump (10) can be used to lift a stranded elevator car, for instance where the elevator car is stranded between floors due to a failure or outage of primary pump (12). Other suitable configurations and uses for auxiliary pump (10) will be apparent to one with ordinary skill in the art in view of the teachings herein.

Having shown and described various embodiments of the present disclosure, further adaptations of the methods and systems described herein may be accomplished by appropriate modifications by one of ordinary skill in the art without departing from the scope of the present disclosure. Several of such potential modifications have been mentioned, and others will be apparent to those skilled in the art. For instance, the examples, embodiments, geometries, materials, dimensions, ratios, steps, and the like discussed above are illustrative and are not required. Accordingly, the scope of the present disclosure should be considered in terms of the following claims and is understood not to be limited to the details of structure and operation shown and described in the specification and drawings.

We claim:

1. A pumping unit for use with an hydraulic elevator system having a hydraulic cylinder for raising and lowering an elevator car, wherein the pumping unit comprises:

a reservoir configured to store fluid;

a first pump in fluid communication with the reservoir, wherein the first pump is in direct fluid communication with the hydraulic cylinder such that the first pump is operable to transfer fluid from the reservoir directly to the hydraulic cylinder to drive the elevator car; and a second pump in fluid communication with the reservoir, wherein the second pump comprises an outlet conduit coupling the second pump with the hydraulic cylinder of the elevator system, wherein the second pump further comprises an inlet conduit coupling the reservoir with the second pump, wherein the second pump is in direct fluid communication with the hydraulic cylinder such that the second pump is operable to transfer fluid from the reservoir directly to the hydraulic cylinder to drive the elevator car, wherein the second pump is selectively actuatable when the first pump is inactivated.

2. The pumping unit of claim 1, wherein the second pump comprises a bypass conduit coupling the second pump with the reservoir, wherein the second pump is operable to transfer fluid from the second pump to the reservoir through the bypass conduit.

3. The pumping unit of claim 2, wherein the bypass conduit comprises a valve to selectively transfer fluid through the bypass conduit.

4. The pumping unit of claim 3, wherein the pumping unit comprises a timer set to a pre-determined amount of time, wherein the pumping unit is operable to close the valve to prevent fluid from flowing through the bypass conduit when the pre-determined amount of time on the timer expires.

5. The pumping unit of claim 1, wherein the second pump comprises a relief conduit coupling the second pump to the reservoir, wherein the second pump is operable to transfer fluid from the second pump to the reservoir through the relief conduit.

6. The pumping unit of claim 5, wherein the relief conduit further comprises a valve to selectively transfer fluid through the relief conduit.

7. The pumping unit of claim 6, wherein the valve is configured to open when pressure in a manifold of the second pump exceeds a pre-determined value.

8. The pumping unit of claim 1, wherein the outlet conduit comprises a one-way check valve configured to prevent the flow of fluid from the hydraulic cylinder of the elevator system to the second pump.

9. The pumping unit of claim 1, wherein the inlet conduit comprises a strainer.

10. The pumping unit of claim 1, wherein the second pump comprises an AC motor.

11. The pumping unit of claim 10, wherein the pumping unit further comprises a contactor coupled to the motor, wherein the contactor is operable to communicate power to the motor.

12. The pumping unit of claim 1, wherein the pumping unit is operable to selectively supply power to the second pump.

13. The pumping unit of claim 1, wherein the second pump comprises a lower flow rate than the first pump.

14. A method of operating a pumping unit for use with a hydraulic elevator system, wherein the pumping unit comprises a reservoir, a first pump in fluid communication with the reservoir, and a second pump in fluid communication with the reservoir, the method comprising the steps of:

activating power to the second pump when the first pump is inactivated;

supplying fluid from the reservoir to a manifold of the second pump through an inlet conduit of the second pump;

returning fluid from the manifold to the reservoir through a bypass conduit;

actuating a valve to close the bypass conduit; and supplying fluid from the manifold directly to the elevator system through an outlet conduit of the second pump to drive the elevator system, wherein fluid is supplied from the manifold to the elevator system after a pressure in the manifold exceeds a pressure in the elevator system.

15. The method of claim 14, wherein the second pump raises an elevator car of the elevator system.

16. The method of claim 14, further comprising returning fluid from the manifold to the reservoir through a relief conduit when the pressure in the manifold exceeds a pre-determined amount of pressure.

17. The method of claim 14, further comprising deactivating the second pump, wherein the second pump comprises a valve to prevent flow between second pump and the elevator system when the second pump is deactivated to hold an elevator car of the elevator system in position.

* * * * *